US008307885B2

(12) United States Patent
Kim et al.

(10) Patent No.: US 8,307,885 B2
(45) Date of Patent: Nov. 13, 2012

(54) COOLING APPARATUS FOR ELECTRONIC DEVICE

(75) Inventors: Ye-Yong Kim, Suwon-si (KR); Young-Don Choi, Seoul-si (KR)

(73) Assignees: LG Electronics Inc., Seoul (KR); Korea University Industrial & Academic Collaboration Foundation, Seoul (KR)

( * ) Notice: Subject to any disclaimer, the term of this patent is extended or adjusted under 35 U.S.C. 154(b) by 938 days.

(21) Appl. No.: 12/390,201

(22) Filed: Feb. 20, 2009

(65) Prior Publication Data

US 2009/0320500 A1 Dec. 31, 2009

(30) Foreign Application Priority Data

Jun. 27, 2008 (KR) ..... 10-2008-0061826

(51) Int. Cl.
*F28D 15/00* (2006.01)
*F25B 9/02* (2006.01)

(52) U.S. Cl. ..... 165/104.26; 165/104.22; 165/104.33; 62/5

(58) Field of Classification Search ..... None
See application file for complete search history.

(56) References Cited

U.S. PATENT DOCUMENTS 3,307,366 A * 3/1967 Smith ..... 62/5
3,677,336 A * 7/1972 Moore, Jr. ..... 165/104.24
4,345,440 A * 8/1982 Allen et al. ..... 62/116
4,765,148 A * 8/1988 Ohashi ..... 62/116
6,244,573 B1 * 6/2001 Rock ..... 261/79.1
6,564,860 B1 * 5/2003 Kroliczek et al. ..... 165/104.26
8,069,678 B1 * 12/2011 Bernert ..... 62/50.2

FOREIGN PATENT DOCUMENTS

JP 06002964 A * 1/1994

* cited by examiner

*Primary Examiner* — Frantz Jules
*Assistant Examiner* — Keith Raymond
(74) *Attorney, Agent, or Firm* — Birch, Stewart, Kolasch & Birch, LLP

(57) ABSTRACT

The present invention relates to a cooling apparatus for an electronic device. In the present invention, a coolant passing through a condenser 10 is introduced into and s filled in a compensator 15. The coolant passing through the compensator 15 is introduced into a vaporizer 20 and vaporized through heat exchange with an auxiliary heat source H2 provided outside of the vaporizer. In addition, a vaporizing unit 22 made of a porous material is provided in the vaporizer 20. The coolant passing through the vaporizer 20 and a liquid coolant supplied from the condenser 10 are mixed in a vortex generating unit 30 to form a coolant spray, and the coolant spray moves along a spiral trajectory to be formed into a vortex. Meanwhile, the coolant spray of a vortex is injected to be in close contact with the inner wall of an evaporator 50 to be heat-exchanged with a main heat source H1 positioned outside of the evaporator, thereby cooling the main heat source H1.

According to the present invention as mentioned above, the main heat source adjacent to the evaporator is heat-exchanged with the coolant more actively to thereby improve the cooling performance of the electronic device. Also, a pressure loss of the coolant spouted from the venturi tube is further reduced.

19 Claims, 8 Drawing Sheets

Loss coefficient for a typical conical diffuser

COOLING APPARATUS FOR ELECTRONIC DEVICE

RELATED APPLICATION

The present disclosure relates to subject matter contained in priority Korean Application No. 10-2008-0061826, filed on Jun. 27, 2008, which is herein expressly incorporated by reference in its entirely.

BACKGROUND OF THE INVENTION

1. Field of the Invention

The present invention relates to an electronic device, and more particularly, to a cooling apparatus for an electronic device, which is used for effectively cooling heat generated from a heat source provided in the electronic device.

2. Description of the Related Art

In the modern society, information technology is rapidly improved, and electronic devices such as computers are recognized as essential tools in home, office, government and the like. Due to an increase of data storage density, improvement of operating speed and reduction of production costs, production and sales of such electronic devices tend to be increasing.

In designing electronic devices such as computers, heat radiation is one of issues that should be considered. In recent, when development of small portable electronic devices such as notebooks, PMPs and cellular phones is accelerated, heat radiation is a very important factor in such portable electronic devices. This is because as electronic devices become smaller, semiconductor elements mounted in such electronic devices are integrated in a larger scale, which generates a larger amount of heat.

In particular, in a computer, a chip constituting a CPU acts as a largest heat source, and a dual-core chip recently put into the market generates great heat over 35 W. As parts mounted in an electronic device have higher performance, they generate an increased amount of heat. Thus, there is a problem in that it is not in reason to discharge heat generated from an electronic device to the outside by an existing cooling apparatus having a cooling fan or heat pipe. As a result, a cooling apparatus having better cooling performance is required for cooling large-scale integrated parts.

SUMMARY OF THE INVENTION

Accordingly, the present invention is conceived to solve the aforementioned problems in the prior art. An object of the present invention is to improve cooling performance by allowing a vortical coolant to be introduced into an evaporator.

Another object of the present invention is to minimize a pressure loss occurring during a coolant circulation process.

According to an aspect of the present invention for achieving the objects, there is provided a cooling apparatus for an electronic device, which comprises a condenser for condensing a coolant; a vaporizer having a vaporizing unit, the coolant passing through the condenser being introduced into the vaporizing unit and vaporized by heat exchange with an auxiliary heat source provided outside of the vaporizing unit, the vaporizing unit being made of a porous material; a venturi tube allowing the coolant passing through the vaporizer to be spouted with low pressure; an injecting unit positioned in a spouting port of the venturi tube, the injecting unit causing the coolant passing through the venturi tube to move along a spiral trajectory and to be formed into a vortex; and an evaporator allowing heat exchange between the coolant spray and a main heat source located outside of the evaporator, the vortical coolant spray is injected to be in close contact with an inner wall of the evaporator having a circular flow cross sectional area by centrifugal force while the vortical coolant spray passes through the evaporator.

The injecting unit may include a body; and a vortex rib spirally formed on an outer surface of the body to form a vortex.

The injecting unit may further include a guide provided at a front end of the body with a shape corresponding to the spouting port and located to be spaced apart from an inner wall of the venturi tube that defines the spouting port, thereby forming a spouting path along which the coolant moves.

The guide may be formed in a conical shape.

The vortex rib may be partially cut so that the coolant moves toward the evaporator.

The venturi tube may be formed with an introduction port into which the coolant in a liquid state passing through the condenser is introduced.

The cooling apparatus may further comprise a coolant channel pipe through which the coolant discharged from the condenser moves; a diverging end installed at one side of the coolant channel pipe to guide the coolant to the vaporizer and the introduction port; and a diverging pipe having one end connected to the diverging end and the other end connected to one end of the introduction port.

An introduction channel through which the coolant passing through the condenser is introduced may be formed at a front end of the vaporizing unit, a plurality of discharge ribs may be formed at regular intervals around an outer surface of the vaporizing unit at the rear end thereof, and a discharge channel through which the coolant vaporized by heat exchange in the vaporizer is discharged may be formed between the discharge ribs.

The introduction channel may be formed to be located at a center on a longitudinal cross section of the vaporizing unit and a plurality of discharge channels may be formed to surround the introduction channel.

The vaporizer, the vortex generating unit and the evaporator may have a pipe shape to communicate with each other.

The auxiliary heat source and the main heat source may be a single heat generating component.

According to another aspect of the present invention, there is provided a cooling apparatus for an electronic device, which comprises a condenser for condensing a coolant; a vaporizer having a vaporizing unit, the coolant passing through the condenser being introduced into the vaporizing unit and vaporized by heat exchange with an auxiliary heat source provided outside of the vaporizing unit, the vaporizing unit being made of a porous material; a venturi tube allowing the coolant passing through the vaporizer to be spouted with low pressure; a spouting port formed in succession to the venturi tube and formed at a predetermined angle to widen a flow cross sectional area; a guide located inside of the spouting port and forming a spouting path to guide the coolant passing through the venturi tube in a direction away from a center thereof; and an evaporator allowing heat exchange between the coolant and a main heat source located outside of the evaporator while the coolant passes through the evaporator.

The spouting path may guide the coolant to move toward an inner wall of the evaporator in which the coolant heat-exchanges with the main heat source.

The guide may be formed in a conical shape.

The venturi tube may be formed with an introduction port into which the coolant in a liquid state passing through the condenser is introduced.

The cooling apparatus may further comprise a coolant channel pipe through which the coolant discharged from the condenser moves; a diverging end installed at one side of the coolant channel pipe to guide the coolant to the vaporizer and the introduction port; and a diverging pipe having one end connected to the diverging end and the other end connected to one end of the introduction port.

An introduction channel through which the coolant passing through the condenser is introduced may be formed at a front end of the vaporizing unit, a plurality of discharge ribs may be formed at regular intervals around an outer surface of the vaporizing unit at the rear end thereof, and a discharge channel through which the coolant vaporized by heat exchange in the vaporizer is discharged may be formed between the discharge ribs.

The introduction channel may be formed to be located at a center on a longitudinal cross section of the vaporizing unit, and a plurality of discharge channels may be formed to surround the introduction channel.

The vaporizer, the vortex generating unit and the evaporator may have a pipe shape to communicate with each other.

The auxiliary heat source and the main heat source may be a single heat generating component.

According to a further aspect of the present invention, there is provided a cooling apparatus for an electronic device, which comprises a condenser for condensing a coolant; a vaporizer having a vaporizing unit, the coolant passing through the condenser being introduced into the vaporizing unit and vaporized by heat exchange with an auxiliary heat source provided outside of the vaporizing unit, the vaporizing unit being made of a porous material; a venturi tube allowing the coolant passing through the vaporizer to be spouted with low pressure; a spouting port formed in succession to the venturi tube and formed at a predetermined angle to widen a flow cross sectional area; an introduction port allowing the coolant in a liquid state passing through the condenser to be introduced into the venturi tube; a coolant channel pipe allowing the coolant discharged from the condenser to move through coolant channel pipe; a diverging end installed at one side of the coolant channel pipe to guide the coolant to the vaporizer and the introduction port; a diverging pipe having one end connected to the diverging end and the other end connected to one end of the introduction port; and an evaporator allowing heat exchange between the coolant and a main heat source located outside of the evaporator while the coolant passes through the evaporator, the evaporator discharging the coolant to the condenser.

The auxiliary heat source and the main heat source may be a single heat generating component.

According to a still further aspect of the present invention, there is provided a cooling apparatus for an electronic device, which comprises an evaporator for absorbing heat from a heat source; a condenser allowing a coolant in a gas state introduced from the evaporator to be condensed; and a pipe for connecting the evaporator and the condenser to form a closed loop, the pipe allowing the coolant to pass therethrough, wherein a vaporizer is installed on a path along which the coolant condensed in the condenser flows to the evaporator through the pipe, a vaporizing unit made of a porous material is installed in the vaporizer, an introduction channel is formed at a front end of the vaporizing unit so that the coolant passing through the condenser is introduced into the introduction channel, and a discharge channel is formed at a rear end of the vaporizing unit so that the coolant vaporized by heat exchange in the vaporizing unit is discharged through the discharge channel.

The introduction channel may be formed to be located at a center on a longitudinal cross section of the vaporizing unit, and a plurality of discharge channels may be formed to surround the introduction channel.

The introduction channel may be formed through the vaporizing unit up to a predetermined depth thereof on a longitudinal cross section of the vaporizing unit, and the discharge channel may be partially overlapped with the introduction channel and exposed to the outside.

The cooling apparatus may further comprise an injecting unit positioned at a rear end of the discharge channel and allowing the coolant discharged from the discharge channel to move along a spiral trajectory and to be formed into a vortex; and an evaporator allowing heat exchange between the coolant and a main heat source located outside of the evaporator, the vortical coolant is injected to an inner wall of the evaporator having a circular flow cross sectional area by centrifugal force while the vortical coolant passes through the evaporator.

The cooling apparatus may further comprise a venturi tube positioned between the vaporizing unit and the injecting unit to allow the coolant discharged from the discharge channel of the vaporizer to be spouted at low temperature; and a spouting port formed in succession to the venturi tube and formed at a predetermined angle to widen a flow cross sectional area, the spouting port allowing the coolant to move to the injecting unit.

The cooling apparatus may further comprise a guide located inside of the spouting port and forming a spouting path to guide the coolant passing through the venturi tube in a direction away from a center thereof.

DESCRIPTION OF THE PREFERRED EMBODIMENT

Hereinafter, a preferred embodiment of a cooling apparatus for an electronic device according to the present invention will be described in detail with reference to the accompanying drawings.

Figure 1:
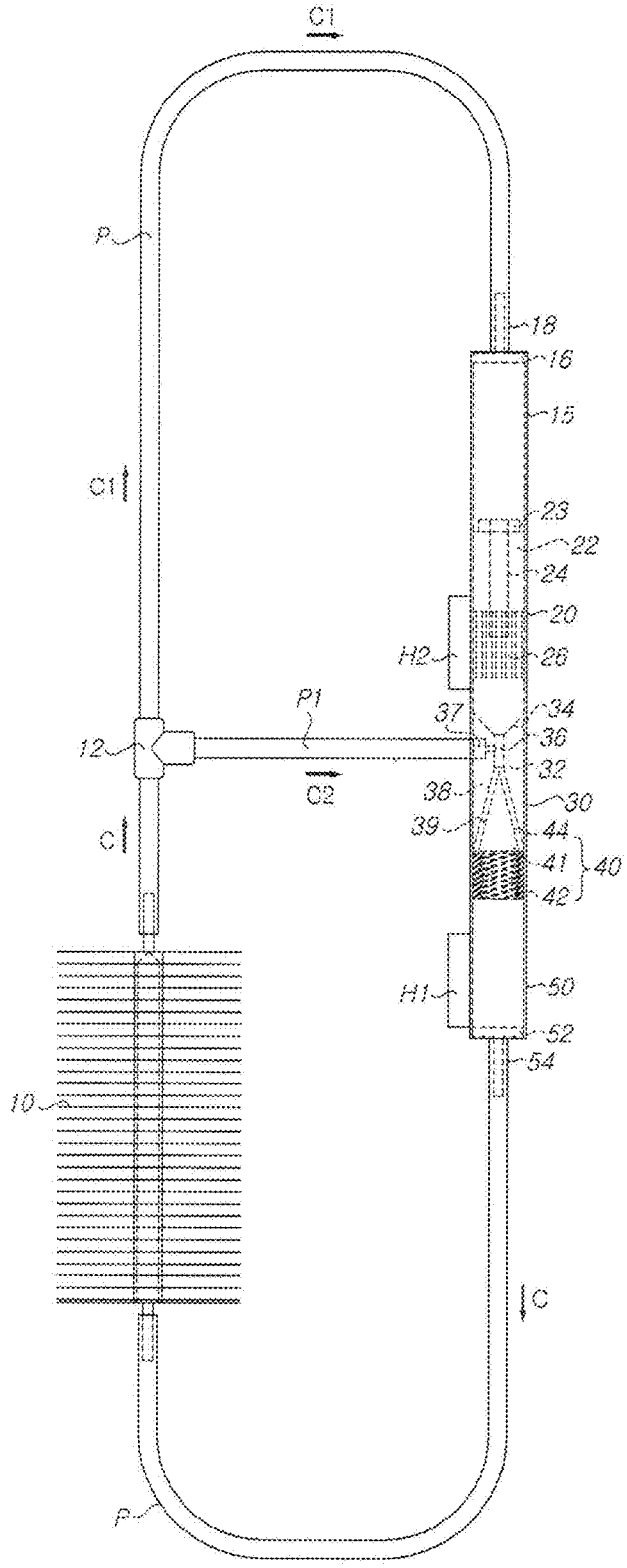
FIG. 1 is a view showing a preferred embodiment of a cooling apparatus for an electronic device according to the present invention.
Figure 2:
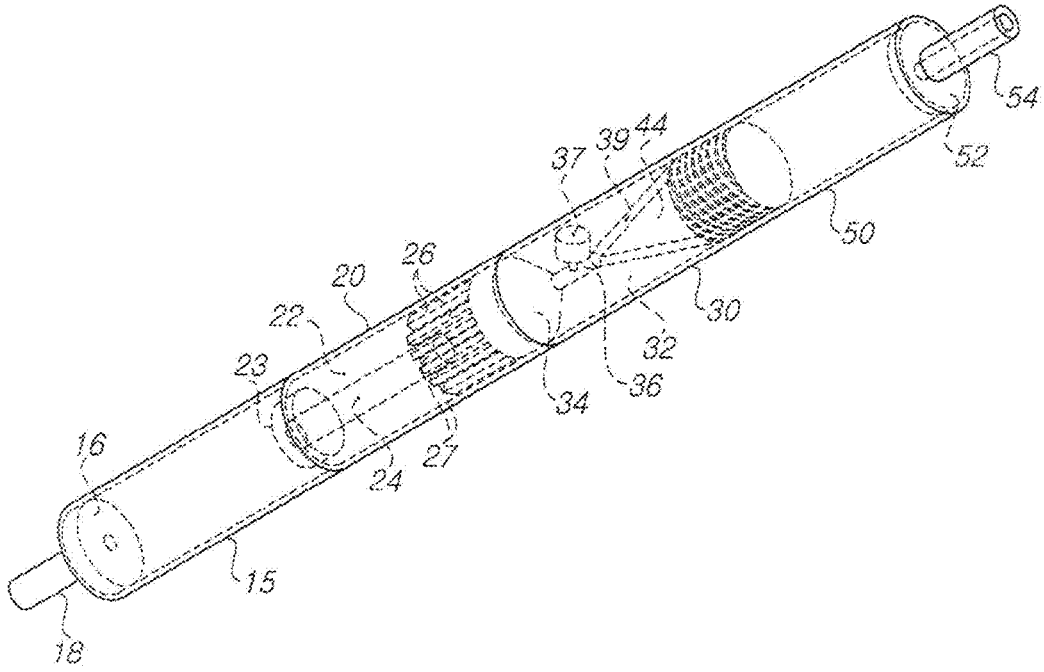
FIG. 2 is a perspective view showing a major portion of the cooling apparatus for an electronic device according to the present invention.

FIG. 1 is a view showing a preferred embodiment of a cooling apparatus for an electronic device according to the present invention, and FIG. 2 is a perspective view showing a major portion of the cooling apparatus for an electronic device according to the present invention.

As shown in the figures, the cooling apparatus for an electronic device according to the present invention includes a condenser 10, a compensator 15, a vaporizer 20, a vortex generating unit 30 and an evaporator 50. Here, the compensator 15, the vaporizer 20, the vortex generating unit 30 and the evaporator 50 have pipe shapes connected in order as a whole, and communicate with each other.

The condenser 10 serves to condense a coolant introduced from the evaporator 50. That is, the coolant vaporized in the evaporator 50 is introduced into the condenser 10 and then condensed into a liquid coolant through heat exchange. In this embodiment, the condenser 10 is provided with cooling pins. The coolant condensed in the condenser 10 is divided at a diverging end 12 and then respectively introduced into the compensator 15 and the vortex generating unit 30. The coolant is introduced into the vortex generating unit 30 through a diverging pipe P1 which has one end connected to one end of the diverging end 12 and the other end connected to an introduction port 37, which will be described later.

That is, a portion of the coolant condensed in the condenser 10 is introduced into the compensator 15 through a coolant channel pipe P. The compensator 15 is a portion which is filled with a liquid coolant. The compensator 15 is not necessarily essential in this embodiment, and the configuration in which the coolant condensed in the condenser 10 is directly introduced into the vaporizer 20 is also possible.

A stopper 16 is provided at one end of the condenser 10 to close one end of the compensator 15. The stopper 16 has through holes in its right and left side ends on the figure, with a central axis as a center, thereby allowing a coolant to flow. The left side end of the stopper 16 on the figure is inserted into a connection pipe 18, and the right side end is positioned within the compensator 15. The right side end of the stopper 16 has a greater diameter than the left side end, thereby preventing the stopper 16 from being fully inserted into the connection pipe 18. In addition, the connection pipe 18 is connected to the coolant channel pipe P.

In this embodiment, the stopper 16 and the connection pipe 18 are not essential, but one end of the compensator 15 may be configured to directly communicate with the coolant channel pipe P.

The vaporizer 20 is connected to one end of the compensator 15. The vaporizer 20 serves to vaporize the liquid coolant introduced from the compensator 15. To this end, an additional auxiliary heat source H2 is provided outside of the vaporizer 20. The vaporizer 20 vaporizes the liquid coolant using the heat absorbed from the auxiliary heat source H2. The auxiliary heat source H2 may also be a heating part that is mounted in the electronic device to generate heat. Here, the auxiliary heat source H2 is a heat source having temperature relatively lower than a main heat source H1, which will be described later.

In addition, the coolant made into a vapor state is transferred to the vortex generating unit 30, which will be described later, by a pressure difference between both ends of the vaporizer 20. That is, the vaporizer 20 serves to provide power for circulating the coolant in the cooling apparatus.

Figure 3A:
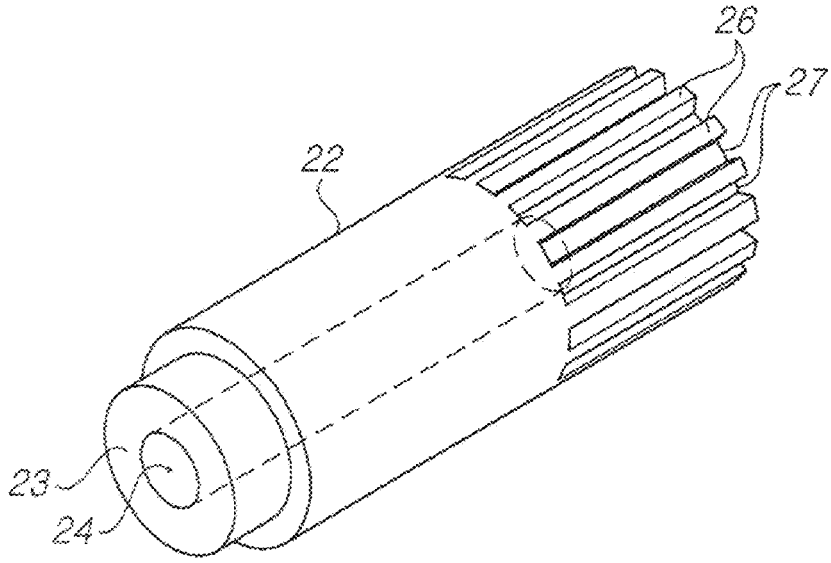
FIG. 3*a* is a perspective view showing an evaporating unit employed in the embodiment of the present invention.
Figure 3B:
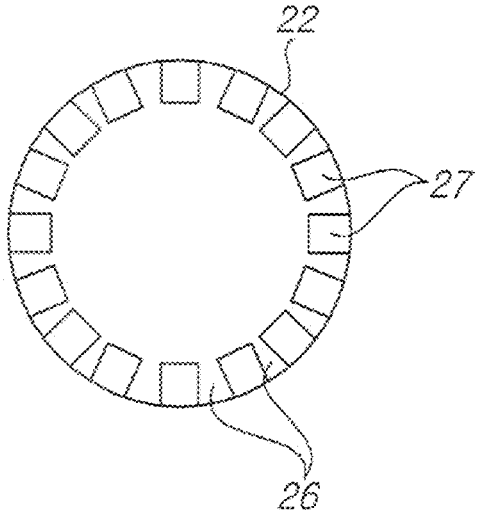
FIG. 3*b* is a rear view of the evaporating unit employed in the embodiment of the present invention.

A vaporizing unit 22 is provided in the vaporizer 20. The configuration of the vaporizing unit 22 is well shown in FIGS. 3*a* and 3*b*. The vaporizing unit 22 substantially makes essential functions of the vaporizer 20. The vaporizing unit 22 has a general circular shape and is made of a porous material. That is, the vaporizing unit 22 is made of a porous material and serves to increase pressure of a gas vaporized by surface tension of capillary tubes.

In the present invention, the vaporizing unit 22 is made of sintered metal. More specifically, the vaporizing unit 22 is formed by sintering stainless steel powder. Also, the vaporizing unit 22 may comprise polyethylene, metal fiber, activated carbon fiber or the like depending on the degree of vapor generation in the vaporizing unit.

A connector 23, which is inserted into one end of the compensator 15 so as to be connected to the compensator 15, is provided to protrude at one end of the vaporizing unit 22. The connector 23 has a relatively smaller diameter than the vaporizing unit 22.

A greatest diameter portion of the vaporizing unit 22 is formed to have a diameter substantially identical to that of an inner wall of the vaporizer 20, so that the vaporizing unit 22 is positioned in close contact with the inner wall of the vaporizer 20.

Also, an introduction channel 24 is formed to extend at a front end of the vaporizing unit 22. The introduction channel 24 is formed to have a predetermined depth into the vaporizing unit 22 at the center of the front end of the vaporizing unit 22, and the introduction channel 24 does not entirely pass through the vaporizing unit 22. The introduction channel 24 is a portion into which the liquid coolant flowing from the compensator 15 is introduced. The liquid coolant introduced through the introduction channel 24 as mentioned above is vaporized by heat exchange with the auxiliary heat source H2. Since the vaporizing unit 22 is made of a porous material to be nearly in a vacuum state, the coolant may be easily vaporized at low temperature.

A rear end of the vaporizing unit 22 is formed to have a relatively small diameter, and discharge ribs 26 are provided around an outer surface thereof. The discharge ribs 26 are formed at regular intervals on the rear end of the vaporizing unit 22. Also, discharge channels 27 are formed between the discharge ribs 26. The discharge channels 27 function as passages through which the coolant introduced into the introduction channel 24 is absorbed and a gaseous coolant is discharged to the vortex generating unit 30. The introduction channel 24 and the discharge channels 27 do not communicate with each other, but they are independently formed in the vaporizing unit 22. The coolant absorbed into the introduction channel 24 moves to the discharge channels 27 through the inside of the vaporizing unit 22 made of a porous material, and then, is discharged to the outside.

The introduction channel 24 is located at the center on a longitudinal cross section, and the discharge channels 27 are formed to overlap with the introduction channel 24 as much as a predetermined length. Thus, the coolant introduced into the introduction channel 24 is vaporized, thereby being more easily absorbed into the discharge channel 27 and then discharged.

Ring-shaped projections (not shown) may be formed to protrude by a predetermined length on the inner side of the connection portion between the compensator 15 and the vaporizer 20. The projections have a greater diameter than the connector 23 of the vaporizer 20. Thus, the connector 23 is located within the compensator 15, but even though there is a gap between the outer side of the vaporizing unit 22 and the inner wall of the vaporizer 20, a greater part of the vaporizing unit 22 is located in the vaporizer 20.

Meanwhile, the gaseous coolant is transferred to the vortex generating unit 30 by a pressure difference between both ends of the vaporizing unit 22. That is, the coolant is transferred by a pressure difference, which is caused by phase change in a process where the coolant is vaporized.

The vortex generating unit 30 is connected to one end of the vaporizer 20. The vortex generating unit 30 generates a vortex in the stream of the coolant passing through the vaporizer 20 and then injects the vortical coolant toward the inner wall of the evaporator 50, so that the coolant flows while being in close contact with the inner wall of the evaporator 50 by centrifugal force. To this end, a venturi tube 32 and an injecting unit 40 are respectively provided inside of the vortex generating unit 30.

Figure 4:
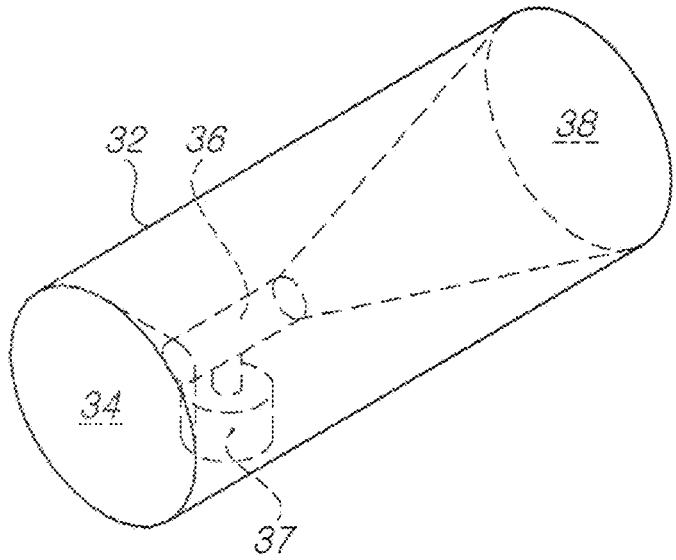
FIG. 4 is a perspective view showing a venturi tube employed in the embodiment of the present invention.

First, the venturi tube 32 will be described with reference to FIG. 4. The venturi tube 32 has a substantial cylindrical shape. The venturi tube 32 has an inlet 34 formed at a portion connected to the vaporizer 20. The inlet 34 is a passage through which the coolant passing through the vaporizer 20 is introduced, and has a substantial conical shape. The inlet 34 is formed such that a flow cross section of coolant is gradually decreased in a moving direction of the coolant.

A spray generating channel 36 is connected to a rear end of the inlet 34. The spray generating channel 36 allows the liquid coolant introduced from the condenser 10 to be mixed with a gaseous coolant to thereby make the coolant in the form of spray. Since the spray generating channel 36 has a small diameter, when a gaseous coolant passes through the spray generating channel 36, the liquid coolant is pulled up due to pressure drop to thereby generate spray. Hereinafter, this is referred to as coolant spray for convenient explanation.

Also, the introduction port 37 is formed in the venturi tube 32 to be open such that the spray generating channel 36 communicates with the condenser 10. Thus, the coolant condensed in the condenser 10 is introduced into the spray generating channel 36 through the diverging pipe P1 connected to the diverging end 12 and the introduction port 37.

A spouting port 38 is connected to a rear end of the spray generating channel 36. The spouting port 38 is a passage through which the coolant spray passing through the spray generating channel 36 is spouted, and has a generally conical shape similarly to the inlet 34. That is, the spouting port 38 has a flow cross sectional area gradually increased in a moving direction of coolant.

Figure 5:
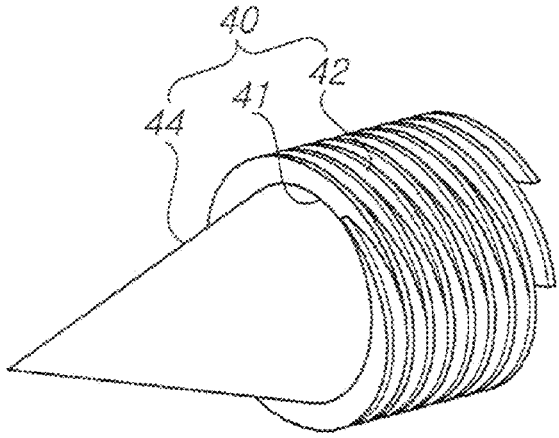
FIG. 5 is a side view showing an injecting unit employed in the embodiment of the present invention.

Meanwhile, the injecting unit 40 is provided at a portion adjacent to the spouting port 38. The shape of the injecting unit 40 is well shown in FIG. 5. The injecting unit 40 is in close contact with and fixed to the inner wall of the vortex generating unit 30. The injecting unit 40 serves to generate a vortex in the coolant spray discharged to the spouting port 38 and then inject the coolant spray toward the inner wall of the evaporator 50. That is, if the coolant spray is vertically formed by the injecting unit 40 and then injected toward the inner wall of the evaporator 50 by centrifugal force, available coolant spray is evaporated by the heat from the main heat source H1, thereby promoting heat exchange and providing a greater cooling effect.

A generally cylindrical body 41 is provided in the injecting unit 40. Also, a vortex rib 42 is provided to protrude on the outer surface of the body 41. The vortex rib 42 is formed in a spiral shape on the body 41. Thus, the coolant spray discharged through the spouting port 38 is formed into a vortex along the vortex rib 42 while passing through the body 41, and then, injected to the evaporator 50. The vortex rib 42 may be formed to have not only a shape shown in the figures but also another shape, such as a double spiral shape, capable of forming a vortex in the coolant spray.

In this embodiment, the vortex rib 42 is cut in its middle portion, so that a portion of the coolant flows directly toward the evaporator 50 through the cut portion, and the other coolant is formed into a vortex by the vortex rib 42 and then injected to the evaporator 50. Here, the vortex rib 42 may be formed to have a plurality of cut portions.

In addition, a guide 44 is provided at a front end of the body 41. The guide 44 is provided to protrude on the front end of the body 41 and positioned on the spouting port 38. The guide 44 is formed to have the same angle as a discharge angle of the spouting port 38 and has a conical shape of a relatively smaller diameter than that of the spouting port 38. The guide 44 is positioned to be spaced apart from the inner wall of the venturi tube 32 corresponding to the spouting port 38. That is, the outer surface of the guide 44 is formed in parallel with the inner wall of the venturi tube 32. The guide 44 serves to guide the coolant spray discharged through the spouting port 38 to be introduced into the vortex rib 42.

In this embodiment, the reason why the guide 44 is located in the spouting port 38 will be described with reference to FIGS. 6 and 7. For reference, FIG. 7 shows a pressure loss of coolant spouted from a conical diffuser. That is, it shows the degree of pressure loss of coolant according to a discharge angle θ of the spouting port of the diffuser.

If the coolant spray is discharged from the narrow channel of the venturi tube 32 and then reaches the spouting port 38, the pressure is decreased to thereby decrease flow rate and flux of the coolant.

Figure 6:
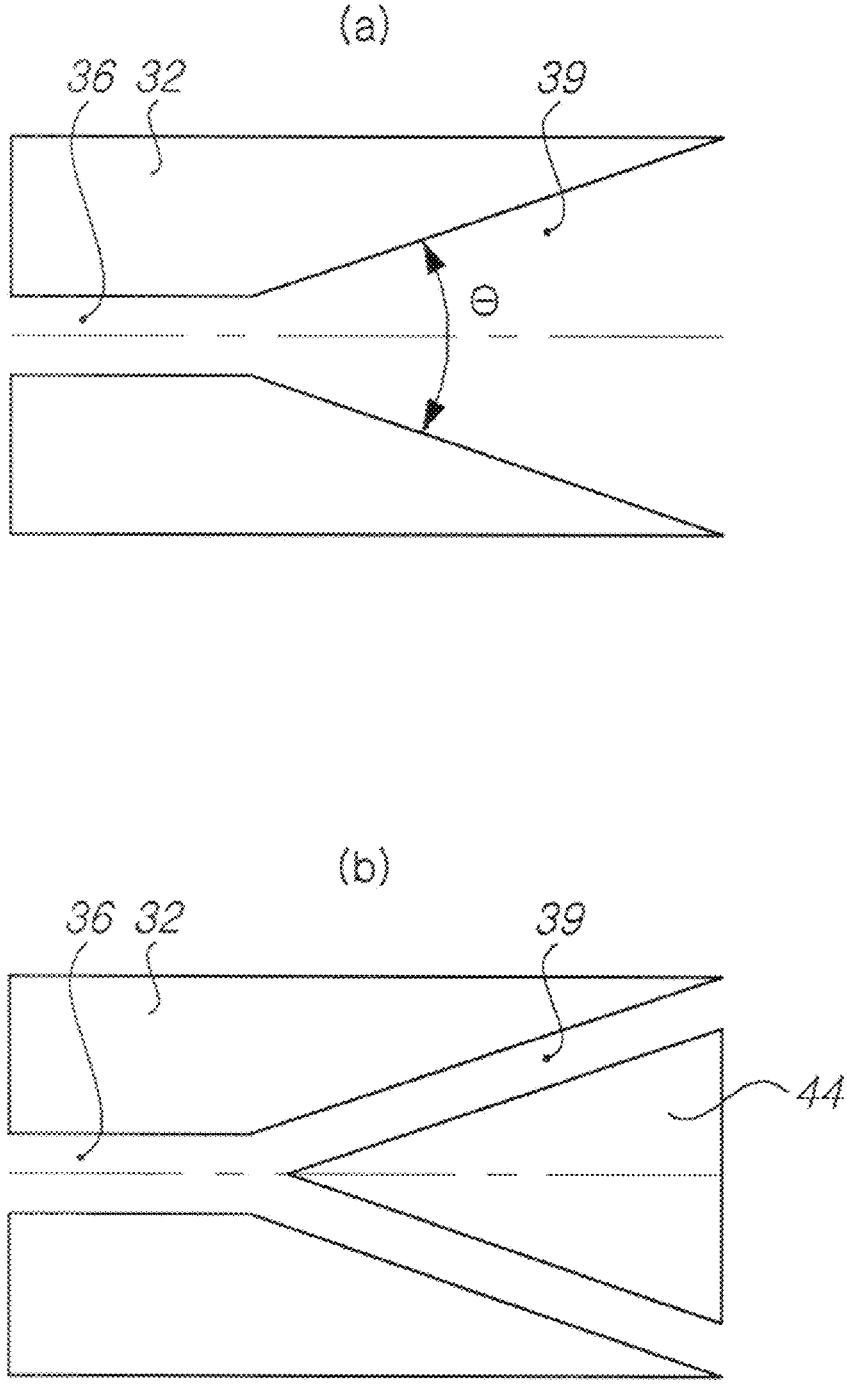
FIG. 6 is a view for comparing cases with and without the injecting unit employed in the embodiment of the present invention.
Figure 7:
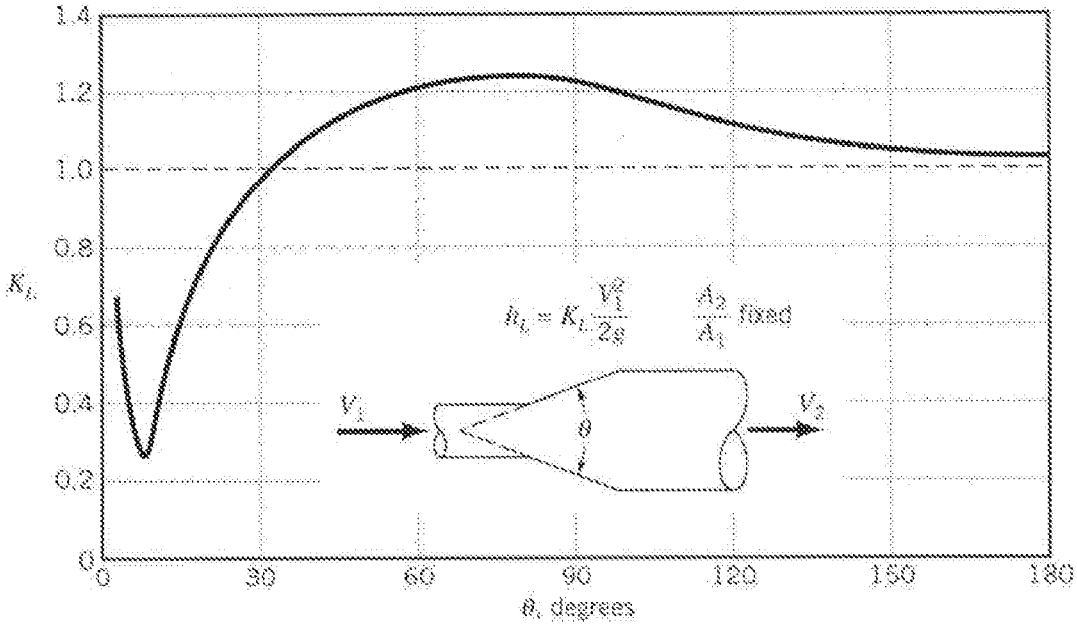
FIG. 7 is a graph showing a pressure loss of a coolant discharged from the venturi tube according to the preferred embodiment of the present invention.

Referring to FIGS. 6 and 7, in a case (FIG. 6(*a*)) where no guide 44 is located in the spouting port 38, if the spouting port 38 is formed to have the discharge angle θ of 30 degrees, flow rate or pressure of the coolant spray are mostly lost while the coolant spray is discharged. However, in a case where the final end of the spouting port 38 has a diameter substantially identical to the diameter of the inner wall of the vortex generating unit 30, a distance from the end of the venturi tube 32 to the final end of the spouting port 38 may be configured to be relatively short.

On the other hand, in a case where the spouting port 38 is formed to have the discharge angle θ of 15 degrees, the degree of loss is decreased to 40% or so, but there is a disadvantage in that a distance from the end of the venturi tube 32 to the final end of the spouting port 38 is relatively increased.

Thus, in order to reduce such a loss, the guide is located in the spouting port 38.

In a case (FIG. 6(*b*)) where the guide 44 is located in the spouting port 38, if the spouting port 38 is formed to have the discharge angle θ of 30 degrees, a flow cross sectional area of a spouting path 39 formed in a space between the spouting port 38 and the guide 44 is maintained constant. That is, since the coolant spray flows through the spouting path 39, the degree of pressure loss may be decreased by about 40%, which ensures substantially identical effects to a case where the spouting port 38 is formed to have the discharge angle θ of 15 degrees, and makes it possible to reduce the length of the venturi tube 32.

In the present invention, the guide 44 has a conical shape so that the flow cross sectional area of the spouting path 39 is constant, but it is also possible that the flow cross sectional area is increased at a portion adjacent to the vortex rib 42.

Also, although the guide 44 and the vortex rib 42 of the injecting unit 40 are formed integrally in this embodiment, the vortex rib 42 may not be formed on the guide 44. In this case, the coolant spray is not formed into a vortex but is discharged toward the inner wall of the evaporator 50.

In addition, in this embodiment, the guide 44 should not be necessarily provided. The guide 44 is to minimize a pressure loss of coolant spray discharged from the venturi tube 32, so that it is also possible that the coolant discharged through the spouting port 38 is formed into a vortex while flowing along the vortex rib 42 without the guide 44.

Also, although the venturi tube 32 and the injecting unit 40 are separately prepared and then assembled in this embodiment, the venturi tube 32 and the injecting unit 40 may be formed as a single member so as to maintain a design cross sectional area of the spouting path 39.

In addition, although the outermost side of the vortex rib 42 of the injecting unit 40 is inserted into the vortex generating unit 30 in this embodiment, the present invention is not limited thereto. The injecting unit 40 may be fixed by means of an additional fixing member (not shown) such that the injecting unit 40 does not rotate.

Next, the evaporator 50 is connected to the vortex generating unit 30. The evaporator 50 is a portion at which the coolant spray passing through the vortex generating unit 30 is evaporated by the main heat source H1 provided adjacent to the evaporator 50. The coolant spray takes heat from the main heat source H1 by heat exchange with the main heat source H1 to thereby cool it The main heat source H1 may be a heating component such as a CPU mounted in an electronic device.

At this time, the coolant spray is formed into a vortex through the vortex generating unit 10 and is injected to the inner wall of the evaporator 50 in the form of droplets. Since the coolant spray formed into a vortex as mentioned above is injected to be in close contact with the inner wall of the evaporator 50 by centrifugal force, the evaporation can be promoted and the heat exchange with the main heat source H1 can be more actively performed. Thus, the cooling effect may be improved in comparison to a prior art in which a coolant just flows along the evaporator 50. The inner wall of the evaporator 50 has a circular flow cross sectional area such that the vortical coolant may easily flows.

The outer periphery of the evaporator 50 may be formed to have a rectangular plate shape so as to increase a contact area with the main heat source H1.

A stopper 52 is provided at one end of the evaporator 50 to block the end of the evaporator 50. In addition, a connection pipe 54 is provided to pass through the stopper 52 and connected to a coolant channel pipe P. The stopper 52 is identical to the stopper 16 in shape and installation. The stopper 52 and the connection pipe 54 should not be necessarily provided, but one end of the evaporator 50 may be configured to directly communicate with the coolant channel pipe P.

Hereinafter, the operation of the cooling apparatus for an electronic device according to the present invention will be described in detail.

First, referring to FIG. 1, a process in which a coolant circulates in the cooling apparatus for an electronic device according to the present invention will be described. Hereinafter, in the coolant C passing through the condenser 10, a coolant introduced into the compensator 15 is referred to as C1, and a coolant introduced into the introduction port 37 is referred to as C2.

The coolant passing through the condenser 10 is partially filled in the compensator 15 while passing through the diverging end 12. The coolant C1 filled in the compensator 15 may vary depending on a material of the vaporizing unit 22. The coolant C1 passing through the compensator 15 is introduced into the vaporizer 20.

Specifically, the coolant C1 is introduced into the vaporizer 20 and introduced into the introduction channel 24 of the vaporizing unit 22. The coolant C1 introduced into the introduction channel 24 is subjected to the heat exchange with the auxiliary heat source H2 provided adjacent to the vaporizer 20. That is, the coolant C1 in a liquid state is vaporized by the heat exchange with the auxiliary heat source 112, and then, the coolant C1 in a gas state moves to the discharge channel 27 through the vaporizing unit 22 made of a porous material and then is discharged. The vaporizing unit 22 increases pressure by surface tension of capillary tubes when vaporizing the coolant. The increased pressure acts as power for the coolant circulation.

Since the inside of the vaporizer 20 is nearly in a vacuum state, even at a low temperature, heat exchange may be easily performed and the liquid coolant C1 may be easily vaporized.

Then, the coolant C1 in a gas state is introduced into the vortex generating unit 30 by a pressure difference between both the ends of the vaporizer 20. The coolant C1 is introduced into the spray generating channel 36 via the inlet 34 of the venturi tube 32. At this time, the coolant C2 in a liquid state is introduced into the spray generating channel 36 through the introduction port 37. The coolant C2 is introduced from the condenser 10 as described above, i.e., is sucked into the narrow spray generating channel by the pressure drop occurring when the coolant passes therethrough. As mentioned above, while being 5 introduced into the spray generating channel 36, the coolant C2 in a liquid state is mixed with the gaseous coolant C1, thereby forming coolant spray C.

The coolant spray C is discharged through the spouting port 38. The coolant spray C is guided and transferred along the spouting path 39 between the inner wall of the venturi tube 32 and the guide 44. Here, referring to FIG. 7, it would be understood that about 40% of pressure loss of the coolant spray C is decreased in comparison to a case where the guide 44 is absent.

Figure 9:
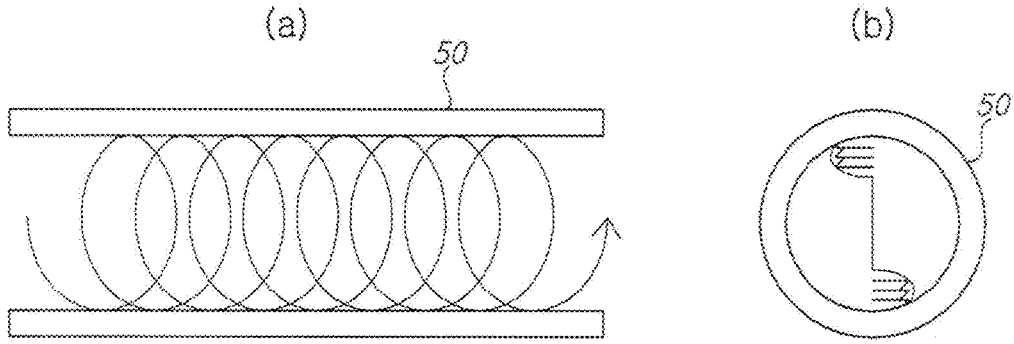
FIG. 9 is a view showing a path of a vortical coolant according to the embodiment of the present invention.

The coolant spray C passing through the guide 44 passes through the vortex rib 42 of the body 41. The coolant spray C moves along a spiral trajectory by the vortex rib 42 to be formed into a vortex and then is discharged to the evaporator 50. The coolant spray C formed into a vortex as mentioned above does not flow without rotation along the evaporator 50 but injected in the form of droplets to the inner wall of the evaporator 50 and then gradually diffused to the inner wall of the evaporator 50 as it goes toward the rear end of the evaporator 50. The path along which the coolant spray C flows while being formed into a vortex in the evaporator 50 is well shown in FIG. 9. That is, the coolant spray C has an increased speed by the centrifugal force to thereby come into close contact with the inner wall of the evaporator 50.

Since the coolant spray C is injected in the form of droplets to the inner wall of the evaporator 50, more effective evaporation is ensured in the evaporator 50. Thus, heat exchange between the coolant spray C and the main heat source H1 adjacent to the evaporator 50 is more actively made, thereby ensuring better cooling of the main heat source H1. The coolant spray C passing through the evaporator 50 is introduced into the condenser 10 in which the coolant spray C is condensed as a liquid coolant again.

In the coolant circulation process explained above the cooling may be performed in the vaporizer 20 and the evaporator 50. Among them, the main heat source H1 generating a greatest amount of heat in an electronic device is provided adjacent to the evaporator 50. That is, the auxiliary heat source H2 adjacent to the vaporizer 20 serves to facilitate vaporization of the liquid coolant C1 in the vaporizer 20 rather than cooling.

However, the auxiliary heat source H2 should not be necessarily used as an element for simply supplying heat, but an additional heat generating component such as the main heat source H1 adjacent to the evaporator 50 may be located adjacent to the vaporizer 20. In this case, two main heat generating components are cooled in an electronic device, thereby further improving the cooling performance. The auxiliary heat source H2 has a relatively lower temperature than the main heat source H1, as explained above.

Figure 8:
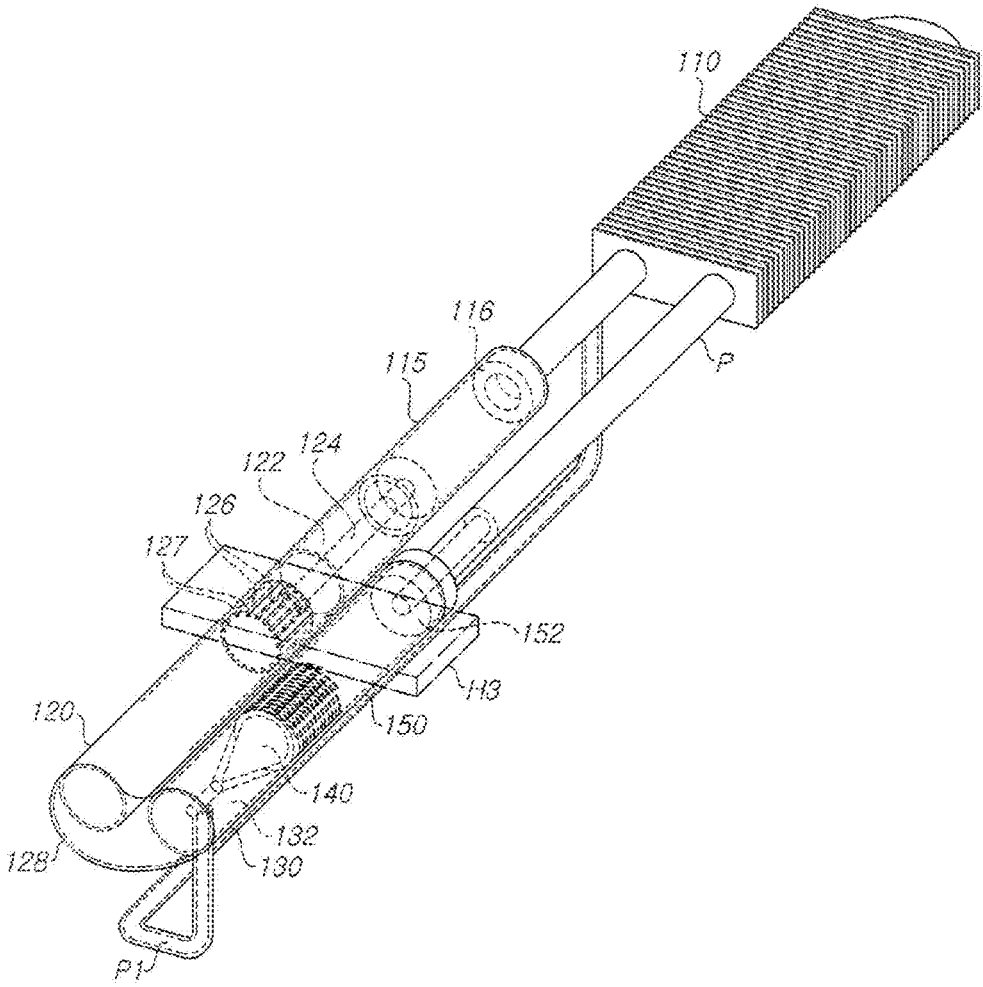
FIG. 8 is a perspective view showing another embodiment of the cooling apparatus for an electronic device according to the present invention.

Meanwhile, hereinafter, a process of cooling a heat source according to another embodiment of the present invention will be described with reference to FIG. 8. Among the components in FIG. 8, reference numerals increased by one hundred are given to the same elements as the previous embodiment, and they will not be described in detail here.

In this embodiment, a reverse carrier 128 is connected to one end of a vaporizer 120. The reverse carrier 128 is in the form of a generally U-shaped pipe. This is to cause a coolant passing through the vaporizer 120 to be transferred in a reverse direction.

The other end of the reverse carrier 128 is connected to a vortex generating unit 130. A coolant passing through the reverse carrier 128 is formed into a vortex in the vortex generating unit 130, and then, is injected to and comes into close contact with an inner wall of an evaporator 150. At this time, a heat source H3 is provided adjacent to both of the vaporizer 120 and the evaporator 150. The heat source H3 may be a heat generating component such as a CPU mounted in an electronic device.

The heat source H3 is heat-exchanged with the vaporizer 120 and the evaporator 150 at the same time. That is, the heat source H3 vaporizes a coolant by the heat exchange with the vaporizer 120 and is cooled by the heat exchange with the evaporator 150. As mentioned above, this embodiment is configured so that the heat source H3 cooled by the evaporator 150 is also heat-exchanged with the vaporizer 120, contrary to the previous embodiment. Thus, the cooling apparatus may be driven without an additional heat source provided at the vaporizer 120.

In a process in which coolant spray passing through the condenser and the vaporizer passes through the vortex generating unit, the coolant spray is formed into a vortex and injected to the inner wall of the evaporator by means of the injecting unit. That is, when the coolant flows in the evaporator, the coolant is formed into a vortex to thereby rotate due to the centrifugal force and move while being in close contact with the inner wall of the evaporator. Thus, there is an advantage in that a main heat source adjacent to the evaporator is heat-exchanged with the coolant more actively to thereby improve the cooling performance of the electronic device.

Further, in the present invention, the guide is located in the spouting port of the venturi tube, so that a discharge angle of coolant is reduced. Accordingly, a pressure loss of the coolant spouted from the venturi tube is reduced, so that the coolant circulates smoothly.

The scope of the present invention is not limited to the embodiments described above but is defined by the appended claims. It will be apparent that those skilled in the art can make various modifications and changes thereto within the scope of the invention defined by the claims.

For example, the evaporator 50 or 150 itself may be used as a heat source without providing an additional heat source at a location adjacent thereto.

Also, the vortex rib 42 or 142 may be formed on the inner wall of the vortex generating unit 30 or 130, or the pipe in the region of the vortex generating unit 30 or 130 may be made in a cylindrical coil shape such that a coolant is formed into a vortex.

In addition, although the vaporizer 20, the vortex generating unit 30 and the evaporator 50 are successively integrally formed in the present invention, the vaporizer 20 and the vortex generating unit 30 may be separately prepared and used.

Also, in the present invention, the vortex rib 42 is formed so that a coolant is formed into a vortex while flowing along the inner wall of the evaporator. Alternatively, instead of the vortex rib 42, a guide passage may be formed such that a coolant is concentrated toward the inner wall that is in contact with the main heat source H1.

What is claimed is:

1. A cooling apparatus for an electronic device, comprising:

a condenser for condensing a coolant;

a vaporizer having a vaporizing unit, the coolant passing through the condenser being introduced into the vaporizing unit and vaporized by heat exchange with an auxiliary heat source provided outside of the vaporizing unit, the vaporizing unit being made of a porous material;

a venturi tube allowing the coolant passing through the vaporizer to be spouted with low pressure;

an injecting unit positioned in a spouting port of the venturi tube, the injecting unit causing the coolant passing through the venturi tube to move along a spiral trajectory and to be formed into a vortex; and an evaporator allowing heat exchange between the coolant and a main heat source located outside of the evaporator, wherein the coolant is injected to be in close contact with an inner wall of the evaporator having a circular flow cross sectional area by centrifugal force while the coolant spray passes through the evaporator, wherein the injecting unit includes a body, and a vortex rib spirally formed on an outer surface of the body to form the vortex, and wherein the injecting unit further includes a guide provided at a front end of the body with a shape corresponding to the spouting port and located to be spaced apart from an inner wall of the venturi tube that defines the spouting port, thereby forming a spouting path along which the coolant moves.

2. The cooling apparatus as claimed in claim 1, wherein the guide is formed in a conical shape.

3. The cooling apparatus as claimed in claim 1, wherein the venturi tube is formed with an introduction port into which the coolant in a liquid state passing through the condenser is introduced.

4. The cooling apparatus as claimed in claim 3, further comprising a coolant channel pipe through which the coolant discharged from the condenser moves; a diverging end installed at one side of the coolant channel pipe to guide the coolant to the vaporizer and the introduction port; and a diverging pipe having one end connected to the diverging end and the other end connected to one end of the introduction port.

5. The cooling apparatus as claimed in claim 1, wherein an introduction channel through which the coolant passing through the condenser is introduced is formed at a front end of the vaporizing unit, a plurality of discharge ribs are formed at regular intervals around an outer surface of the vaporizing unit at the rear end thereof, and a discharge channel through which the coolant vaporized by heat exchange in the vaporizer is discharged is formed between the discharge ribs.

6. The cooling apparatus as claimed in claim 5, wherein the introduction channel is formed to be located at a center on a longitudinal cross section of the vaporizing unit, and a plurality of discharge channels are formed to surround the introduction channel.

7. The cooling apparatus as claimed in claim 1, wherein the vaporizer and the evaporator have a pipe shape.

8. The cooling apparatus as claimed in claim 1, wherein the auxiliary heat source and the main heat source are a single heat generating component.

9. A cooling apparatus for an electronic device, comprising:

a condenser for condensing a coolant;

a vaporizer having a vaporizing unit, the coolant passing through the condenser being introduced into the vaporizing unit and vaporized by heat exchange with an auxiliary heat source provided outside of the vaporizing unit, the vaporizing unit being made of a porous material;

a venturi tube allowing the coolant passing through the vaporizer to be spouted with low pressure;

a spouting port formed in succession to the venturi tube and formed at a predetermined angle to widen a flow cross sectional area;

a guide located inside of the spouting port and forming a spouting path to guide the coolant passing through the venturi tube in a direction away from a center thereof; and an evaporator allowing heat exchange between the coolant and a main heat source located outside of the evaporator while the coolant passes through the evaporator, wherein the spouting path guides the coolant to move toward an inner wall of the evaporator in which the coolant heat-exchanges with the main heat source, and wherein the guide is provided at a front end of the body with a shape corresponding to the spouting port and located to be spaced apart from an inner wall of the venture tube that defines the spouting port, thereby forming a spouting path along which the coolant moves.

10. The cooling apparatus as claimed in claim 9, wherein the guide is formed in a conical shape.

11. The cooling apparatus as claimed in claim 9, wherein the venturi tube is formed with an introduction port into which the coolant in a liquid state passing through the condenser is introduced.

12. The cooling apparatus as claimed in claim 9, further comprising a coolant channel pipe through which the coolant discharged from the condenser moves; a diverging end installed at one side of the coolant channel pipe to guide the coolant to the vaporizer and an introduction port; and a diverging pipe having one end connected to the diverging end and the other end connected to one end of the introduction port.

13. The cooling apparatus as claimed in claim 9, wherein an introduction channel through which the coolant passing through the condenser is introduced is formed at a front end of the vaporizing unit, a plurality of discharge ribs are formed at regular intervals around an outer surface of the vaporizing unit at the rear end thereof, and a discharge channel through which the coolant vaporized by heat exchange in the vaporizer is discharged is formed between the discharge ribs.

14. The cooling apparatus as claimed in claim 13, wherein the introduction channel is formed to be located at a center on a longitudinal cross section of the vaporizing unit, and a plurality of discharge channels are formed to surround the introduction channel.

15. The cooling apparatus as claimed in claim 9, wherein the vaporizer and the evaporator have a pipe shape.

16. The cooling apparatus as claimed in claim 9, wherein the auxiliary heat source and the main heat source are a single heat generating component.

17. A cooling apparatus for an electronic device, comprising:

an evaporator for absorbing heat from a heat source;

a condenser allowing a coolant in a gas state introduced from the evaporator to be condensed; and a pipe for connecting the evaporator and the condenser to form a closed loop, the pipe allowing the coolant to pass therethrough, wherein a vaporizer is installed on a path along which the coolant condensed in the condenser flows to the evaporator through the pipe, a vaporizing unit made of a porous material is installed in the vaporizer, an introduction channel is formed at a front end of the vaporizing unit so that the coolant passing through the condenser is introduced into the introduction channel, and a discharge channel is formed at a rear end of the vaporizing unit so that the coolant vaporized by heat exchange in the vaporizing unit is discharged through the discharge channel, an injecting unit positioned at a rear end of the discharge channel and allowing the coolant discharged from the discharge channel to move along a spiral trajectory and to be formed into a vortex; and an evaporator allowing heat exchange between the coolant and a main heat source located outside of the evaporator, the vortical coolant is injected to an inner wall of the evaporator having a circular flow cross sectional area by centrifugal force while the vortical coolant passes through the evaporator, a venturi tube positioned between the vaporizing unit and the injecting unit to allow the coolant discharged from the discharge channel of the vaporizer to be spouted at low temperature; and a spouting port formed in succession to the venturi tube and formed at a predetermined angle to widen a flow cross sectional area, the spouting port allowing the coolant to move to the injecting unit, a guide located inside of the spouting port and forming a spouting path to guide the coolant passing through the venturi tube in a direction away from a center thereof, wherein the guide is provided at a front end of the body with a shape corresponding to the spouting port and located to be spaced apart from an inner wall of the venturi tube that defines the spouting port, thereby forming a spouting path along which the coolant moves.

18. The cooling apparatus as claimed in claim 17, wherein the introduction channel is formed to be located at a center on a longitudinal cross section of the vaporizing unit, and a plurality of discharge channels are formed to surround the introduction channel.

19. The cooling apparatus as claimed in claim 17, wherein the introduction channel is formed through the vaporizing unit up to a predetermined depth thereof on a longitudinal cross section of the vaporizing unit, and the discharge channel is partially overlapped with the introduction channel.

* * * * *